US007073430B2

(12) United States Patent
Kimmerle

(10) Patent No.: US 7,073,430 B2
(45) Date of Patent: Jul. 11, 2006

(54) STRAPPING APPARATUS

(75) Inventor: Andreas Kimmerle, Höchstädt (DE)

(73) Assignee: Ergopack Deuschland GmbH, Hochstadt (DE)

( * ) Notice: Subject to any disclaimer, the term of this patent is extended or adjusted under 35 U.S.C. 154(b) by 0 days.

(21) Appl. No.: 10/817,613

(22) Filed: Apr. 2, 2004

(65) Prior Publication Data

US 2004/0250699 A1 Dec. 16, 2004

(30) Foreign Application Priority Data

Apr. 4, 2003 (DE) ..... 103 15 530

(51) Int. Cl.
*B65B 13/18* (2006.01)

(52) U.S. Cl. ..... 100/8; 100/27; 100/29; 53/582

(58) Field of Classification Search ..... 100/25, 100/26, 29, 32, 33 R, 27, 8; 53/503, 504, 53/582, 592
See application file for complete search history.

(56) References Cited

U.S. PATENT DOCUMENTS 3,003,296 A * 10/1961 Feldkamp et al. ..... 53/399
3,150,585 A 9/1964 Sterner
3,213,781 A * 10/1965 Collins et al. ..... 100/26
3,376,807 A 4/1968 Sterner
3,867,878 A * 2/1975 Buhne ..... 100/2
3,899,963 A 8/1975 Tremper
4,254,703 A * 3/1981 Fulton et al. ..... 100/2
4,820,363 A * 4/1989 Fischer ..... 156/494
6,516,592 B1 2/2003 Kimmerle
6,722,110 B1 * 4/2004 Royneberg ..... 53/588
6,745,677 B1 * 6/2004 Pearson et al. ..... 100/26

FOREIGN PATENT DOCUMENTS

DE 298 08 111 5/1998
DE 199 16 193 A1 10/2000

* cited by examiner

*Primary Examiner*—Derris H. Banks
*Assistant Examiner*—Jimmy Nguyen
(74) *Attorney, Agent, or Firm*—Davis & Bujold, P.L.L.C.

(57) ABSTRACT

An apparatus for strapping and/or bundling pallets and articles has a strapping device from which a packaging band can be passed around the pallets/articles and has a closure device for subsequent tensioning and closure of the packing band. The strapping device is provided with a guide device on which the closure device is arranged. The guide device supports at least some of the weight of the closure device.

17 Claims, 2 Drawing Sheets

STRAPPING APPARATUS

This application claims priority from German Application No. 103 15 530.9 filed Apr. 4, 2003.

FIELD OF THE INVENTION

The invention relates to an apparatus for strapping and/or bundling pallets and articles, having a strapping device from which a packaging band can be passed around the pallets/articles and having a closure device for subsequent tensioning and closure of the packaging band.

BACKGROUND OF THE INVENTION

Packets or articles are generally mounted on pallets by means of a packaging band, in order to ensure that these packets and articles are transported safely and without being damaged.

In addition to steel bands, plastic bands, predominantly composed of polyester or polypropylene, are also being increasingly used for this purpose. Once the packaging band has been passed around the pallet and the packaged item, the packaging band is tensioned and closed by means of a closure device, for example an electrical hand-held appliance. The power supply for the closure device may be provided both via the mains system and via a rechargeable battery. The closure device may in this case, for example, be a welding appliance with a rechargeable battery.

The closure device is moved onto the band to be closed by the operator, by hand. This has the disadvantage that the closure device is relatively heavy, generally being 2.5 to 6 kilograms. The further exacerbating factor is that the closure device must be held with one hand, since the packaging band must be threaded in using the other hand. This leads to correspondingly high physical stress on the operator.

Once the packaging band has been threaded in, the packing band is tensioned by the closure device, which is generally also in the form of a tensioning device. The parts of the packaging band which are located on top of one another are then welded, and the excess packaging band is cut off. The cut-off end of the packaging band can be rolled up again onto the strapping device, and now represents the start of the packaging band for strapping a further pallet or a further article.

In one simple embodiment, the strapping device may simply be a band unrolling device or a holder for a packaging band roll. In one advantageous embodiment, a design of the strapping device according to the packaging apparatus which is described in DE 199 16 193 C2 and which can be used in a mobile manner is possible.

A further strapping device is disclosed, for example, in DE 298 08 111 U1.

The handling of the closure device is particularly disadvantageous for the operator when the pallet to be closed or the article to be closed is higher than the chest level of the operator since, in this case, the closure device can no longer be placed on the top face of the packaged item, in the normal way. As soon as the pallet to be closed or the article to be closed is higher than the chest level of the operator, the operator has to tension, close and cut off the packaging band in the vertical plane. Owing to the physical state of health, some people cannot carry out this activity. The method, which is otherwise well proven, for packaging pallets and articles by means of a transportable apparatus, in particular according to DE 199 16 193 C2, can thus not be used in some cases.

The disadvantages which result from the use of the closure device in this case apply both to strapping devices which can be used in a mobile manner and to stationary strapping devices.

Even if the pallet or the article is not higher than the chest level of the operator, this does not save the operator having to apply force since, in this case, the closure device must be placed on the top face of the packaged item.

A further disadvantage of the closure device is that, as has been found in practice, these devices often fall down, thus resulting in a considerable risk of injury and, furthermore, the appliances are often damaged.

Holders, so-called balancers, are known from the prior art which are attached to the ceiling and to which the closure devices can be attached by means of a spring cable run. The spring cable run compensates for the weight of the attached closure device, so that it can be used more easily. The balancers have a cable which is wound up on a spool that is supported by a spiral spring.

However, balancers have the disadvantage that they are attached to a girder or to the ceiling in a stationary manner. Mobile use of the transportable apparatuses for strapping and/or bundling pallets or articles is thus not possible. Furthermore, in order to ensure easy accessibility, the closure devices are generally hung at the operator's head height, resulting in a considerable risk of injury.

The main advantages of the mobile apparatus for strapping and/or bundling pallets in contrast to a stationary apparatus, namely the mobility and the independence from a mains connection, are lost by balancers that are mounted in a stationary manner.

SUMMARY OF THE INVENTION

The present invention is thus based on the object of providing an apparatus for strapping and/or bundling pallets and articles, which solves the disadvantages mentioned above of the prior art, in particular allowing a closure device to be used easily, without the application of large forces, and without stress.

According to the invention, this object is achieved in that the strapping device is provided with a guide device on which the closure device is arranged, with the guide device supporting at least some of the weight of the closure device.

Since the strapping device is combined with a guide device which guides and supports the closure device, this allows the closure device to be used in a simple manner, without the application of large forces. The mobility of the strapping device is not restricted by the connection to the closure device, so that the mobile apparatus can be used for strapping and/or bundling pallets or articles without any restriction by stationary elements.

The specific refinement of the strapping device is of secondary importance for the embodiment of the solution according to the invention. Thus, in one refinement, it is possible to provide for the strapping device to be a simple band unrolling device, while the strapping device in one particularly advantageous refinement is designed according to DE 199 16 193 C2. The strapping device may, of course, also be semi-automatic or fully automatic, without the operator having to carry out any manual activity in order to operate the strapping device.

The closure device may advantageously be a combination appliance, which not only tensions the band but also welds it and cuts it off. In simpler refinements, it is also possible, of course, to provide for the packaging band to be tensioned and cut off by other appliances. It is particularly advantageous to use an electrical hand-held appliance which is powered by a rechargeable battery. This may, for example, be a welding appliance with a rechargeable battery, which additionally tensions and cuts off the packaging band. This results in particularly advantageous, independent and mobile use of the entire apparatus.

It is advantageous for the guide device to have a linear guide, at one of whose ends the closure device is arranged.

Trials have shown that compensation for at least some of the weight of the closure device can be carried out in a particularly simple manner by means of a linear guide at one of whose ends the closure device is arranged. Furthermore, the closure device can thus be operated in a simple manner.

It is advantageous for the closure device to be arranged on the linear guide by means of a joint element such that it can be moved.

It is advantageous if the linear guide can be extended parallel to and at a short distance from the packaging band that is unwound from the strapping device. This ensures that the closure device can be moved immediately adjacent to or exactly at the same position as the packaging band in order to close the packaging band once the linear guide has been extended. The moveable arrangement of the closure device by means of the joint element in this case makes it easier, as the inventor has found, to thread the packaging band into the closure device. Once the packaging band has been threaded in, the closure device tensions the packaging band and thus pulls itself against the pallet. In the process, the linear guide at whose end the closure device is arranged is likewise moved closer to the pallet or to the article. It is also advantageous for this purpose for the linear guide to run parallel to and closely adjacent to the unrolled packaging band or to the packaging roll. This avoids tensioning or tilting of the linear guide.

In one physical embodiment of the invention, it is possible for a damping element to be arranged between the linear guide and the joint element, for defined alignment of the closure device.

Trials have shown that an arrangement of a damping element between the joint element and the linear guide is particularly suitable for aligning the closure device with respect to the pallet or the like.

In one particularly preferred refinement, the damping element may in this case be a compressed gas cylinder in order to absorb the weight force of the closure device. As an alternative to this, the damping element may also be a spring or the like.

BRIEF DESCRIPTION OF THE DRAWINGS

Advantageous developments and refinements of the invention will become evident from the exemplary embodiments whose principles are described in the following text with reference to the drawing, in which.

DETAILED DESCRIPTION OF THE INVENTION

Figure 1:
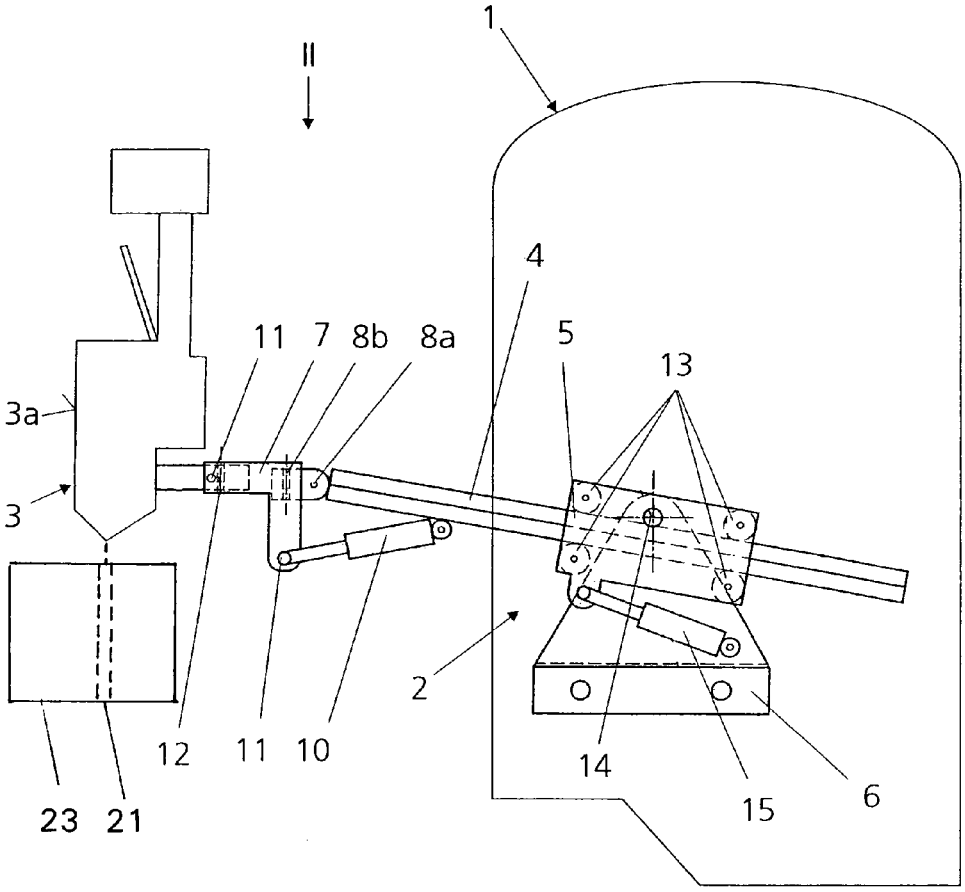
FIG. 1 shows a side view of a strapping device which is provided with a guide device according to the invention, on which a closure device is arranged.

FIGS. 1 to 4 show a mobile apparatus for strapping and/or bundling pallets and articles 23, having a strapping device 1 which is provided with a guide device 2 on which a closure device 3 is arranged. A packaging band 21 can be passed around a pallet or article 23 by means of the strapping device 1. The packaging band is then tensioned, closed and cut off by means of the closure device 3.

Widely different embodiments of strapping devices 1 have been known for a long time from the prior art. These embodiments include both simple holders for the packaging band rollers and machines with a proven technology, as are known, for example, from DE 199 16 193 C2. The solution according to the invention is in this case particularly advantageously suitable for the strapping device which is known from DE 199 16 193 C2, to whose functional description reference is explicitly hereby made.

Various technical embodiments of closure devices 3 have likewise been known for a long time from the general prior art. The closure devices 3 may in this case be operated both via a fixed mains connection and via rechargeable batteries. Electrical hand-held appliances are normally used and are responsible not only for tensioning the packaging band but also for closing it and cutting it off. Hand-held appliances such as these are the basis of the exemplary embodiment. The exemplary embodiment in this case provides for the packaging band to be closed by welding. In this case, the packing band is advantageously a plastic packaging band composed, for example, of polyester or polypropylene.

Since the methods of operation of strapping devices 1 and of closure devices 3 have been known for a long time from the prior art, only the features according to the invention will be described in more detail in the following text.

The strapping device 1 and the closure device 3 are illustrated only schematically in the figures.

As can be seen from FIG. 1, the guide device 2 has a linear guide 4 which is supported on a guide element 5, or is mounted on it. The closure device 3 is in this case arranged at one end of the linear guide 4. In the exemplary embodiment, the linear guide 4 absorbs the weight force of the closure device 3 and is supported on the guide element 5, which is connected via a bracket 6 to the strapping device 1 or to a housing of the strapping device 1. The weight force of the closure device 3 is thus compensated for, so that it no longer stresses the operator.

Figure 2:
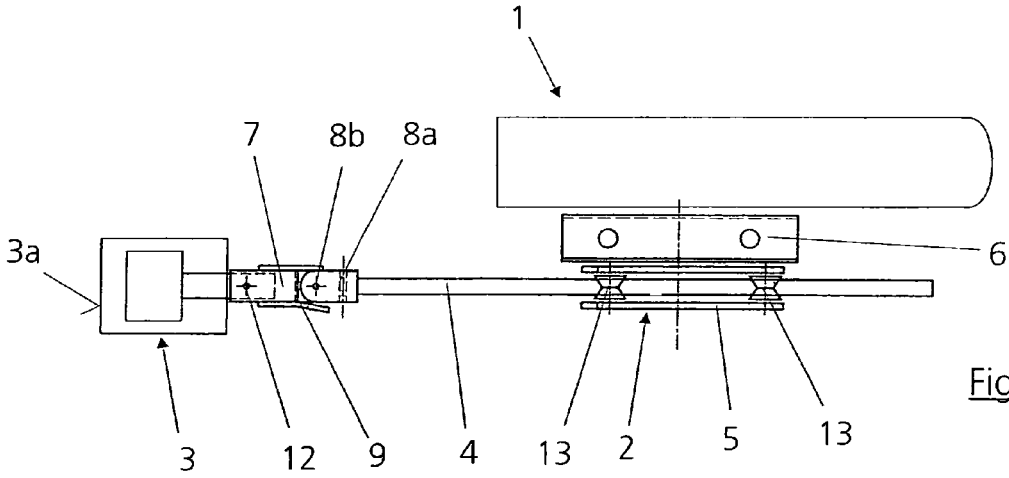
FIG. 2 shows a plan view of the guide device according to the invention, along the direction of the arrow II in FIG. 1.

As can be seen from FIG. 1 and FIG. 2, the closure device 3 is arranged on the linear guide 4 by means of a joint element 7 so that it can move. The joint element 7 allows the closure device 3 to be aligned exactly with respect to the packaging band or packaged item to be closed. Furthermore, the capability of the closure device 3 to pivot makes it simple to thread in the packaging band. The joint element 7 can be pivoted about a horizontal axis 8*a* and a vertical axis 8*b*.

The invention provides for the closure device 3 to be able to pivot only within a predetermined angle range with a maximum of 45° about the vertical axis 8*b* of the joint element 7. As can be seen in this context from FIG. 2, the joint element 7 has a stop 9 for this purpose. The stop 9 in this case allows the packaging band to be unthreaded by slight pivoting movement of the closure device after being tensioned. In this case, it is possible to provide for the pivoting of the closure device 3 to result in a maximum sideways movement of approximately 3 cm. Trials have shown that this is sufficient in order to unthread the band out of a holding slot in the closure device 3 in a simple manner after the completion of the tensioning and closure process.

As can also be seen from FIG. 1 and FIG. 2, a damping element 10 is arranged between the linear guide 4 and the joint element 7 in order to compensate for at least some of the weight force of the closure device 3, and for defined alignment of the closure device 3. As is illustrated in the exemplary embodiment, the damping element 10 may in this case be arranged and aligned such that the closure element 3 has a vertically extending contact surface 3*a* for making contact with a sidewall of a pallet or of an article. The damping element in the illustrated exemplary embodiment is a compressed gas cylinder 10. The compressed gas cylinder 10 may advantageously be set such that the closure device 3 can be pivoted about the horizontal axis 8*a* without having to apply much force.

In the arrangement illustrated in FIG. 1, owing to the vertically running contact surface 3*a* and thus also owing to the vertically running holding opening for the packaging band, the closure element 3 is particularly advantageously suitable for connection of the packaging band in the vertical. If the packet to be closed or the pallet to be closed is not higher than the chest height of the user, then, as an alternative to this, the closure device 3 may also be placed on the top face of the packaged item. The arrangement of the compressed gas cylinder 10 on the joint element 7 may be varied for this purpose. For this purpose, the joint element 7 has two holes 11 which are offset through 90° with respect to one another and which may be used for arrangement of the compressed gas cylinder 10. An L-shaped configuration of the joint element 7 has been found to be particularly suitable for this purpose.

The change to the alignment of the closure device 3 which results a compressed gas cylinder 10 being arranged on the second hole 11 and not, as illustrated in FIG. 1, on the first hole 11 can be carried out easily and is therefore not illustrated in any more detail in the drawing. The arrangement of the compressed gas cylinder 10 on the second hole 11 allows the closure device 3 to be placed, by means of the contact surface 3*a,* in a simple manner on the top face of a packet or of an article.

As an alternative to the L-shaped configuration of the joint element 7, other forms are, of course, also obvious to those skilled in the art.

As can be seen from FIGS. 1 and 2, the closure device 3 is connected to the joint element 7 by means of a detachable connection which, in the exemplary embodiment, is a plug connection 12. The plug connection 12 allows a standardized closure device 3 to be connected in a simple manner to the guide device 2 and thus to the strapping device 1.

As can be seen from FIG. 1 and FIG. 2, the guide element 5 has four rollers 13 for bearing and for supporting the linear guide 4. The linear guide 4 is in this case in the form of a rail. The rollers 13 allow the linear guide 4 to be moved out and back in again in the direction of the pallet or of the articles in a simple manner. The combination of the rollers 13 with a linear guide 4 in the form of a rail has been found to be particularly suitable for this purpose. In this case, it is advantageous for the guide element 5 together with the rollers 13 to be arranged inclined so as to prevent the linear guide 4 from moving on its own in the direction of the pallet or of the articles. Even an inclination through a few degrees with respect to the horizontal is sufficient for this purpose.

The guide element 5 is mounted such that it can rotate, as is illustrated in FIG. 1. The guide element 5 is in this case mounted such that it can rotate about a horizontal axis 14, so that the angle at which the linear guide 4 can be moved out can be varied. The closure device 3 can thus be moved vertically in a simple manner, so that the packaging band can be welded at different heights. Analogously, this also allows the closure element 3 to be placed on pallets with different heights.

As can be seen from FIG. 1, a damping element 15 is provided in order to compensate for the weight force of the closure element 3 and/or the weight force of the guide device 2. The damping element 15 is in this case arranged between the bracket 6 and the guide element 5.

The damping element is a compressed gas cylinder 15. The compressed gas cylinder 15 is set such that the linear guide 4 rises slightly in the direction of the closure device 3 when in an initial position (see FIG. 1). In this case, the compressed gas cylinder 15 compensates for all the weight forces which occur, so that only a small amount of force need be applied in order to move the closure device 3 in the desired direction (guided by the linear guide 4). The weight force of the closure device 3 is in this case compensated for by the compressed gas spring 15. This also applies to the additional weights which result from the guide device 2, such as the weight of the joint element 7. The compressed gas cylinder 10 is used not only to compensate for the weight force of the closure device 3, but also for alignment of the closure device 3. The compressed gas cylinder 10 is in consequence essentially responsible for the tilting movement, and the compressed gas cylinder 15 is responsible for the linear guidance and for the compensation for the weight force (which in the exemplary embodiment results from the closure device 3 or the feed device 2). In this case, it is advantageous for the compressed gas cylinder 15 to be set such that the closure device 3 can tension the packaging band without any relevant opposing pressure. This is made easier by the compressed gas cylinder 15 having to absorb an increased weight force even when the linear guide 4 is in the extended state.

The guide device 2 is mounted in a particularly preferred manner on the strapping device 1 by providing the strapping device 1 with a box for tools or appliances on the side or on the control side. The guide device 2 and the bracket 6 can easily be fitted to this box without impeding the movement of the roller for unwinding the packaging band.

Figure 3:
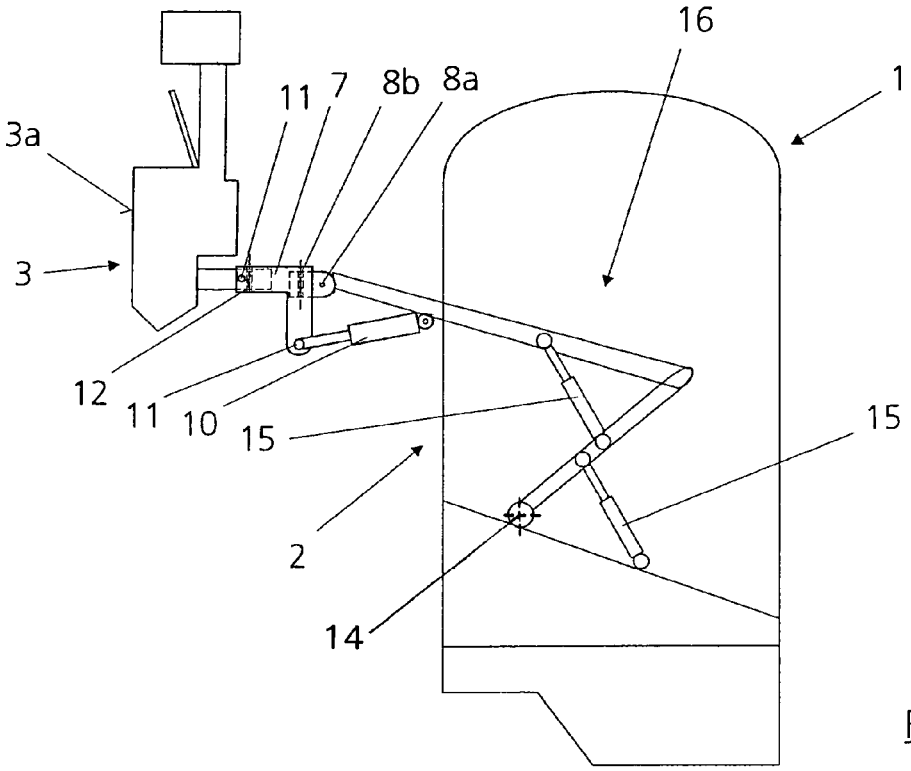
FIG. 3 shows a side view of a strapping device with an alternative refinement of the guide device to that shown in FIG. 1.

FIG. 3 shows an alternative embodiment of the guide device 2 to that shown in FIG. 1. The guide device 2 in this case has no linear guide 4 in the true sense, but is provided with a joint device (or guide element) 16. In this case, a compressed gas cylinder 10 is essentially used for alignment of the closure device 3 (even if weight forces are also absorbed in this case), and a compressed gas cylinder 15 is used to ensure the outward and inward movement and to absorb the weight force which results from the closure device 3 and from the joint device 16. The arrangement of the joint device 16 corresponds essentially to a known bagger arm. Various arrangements of the compressed gas cylinders 10 and 15 as well as different configurations of the joint device 16, which are based on the embodiment as illustrated in FIG. 3, are obvious to those skilled in the art. The physical design will therefore not be described in more detail.

Figure 4:
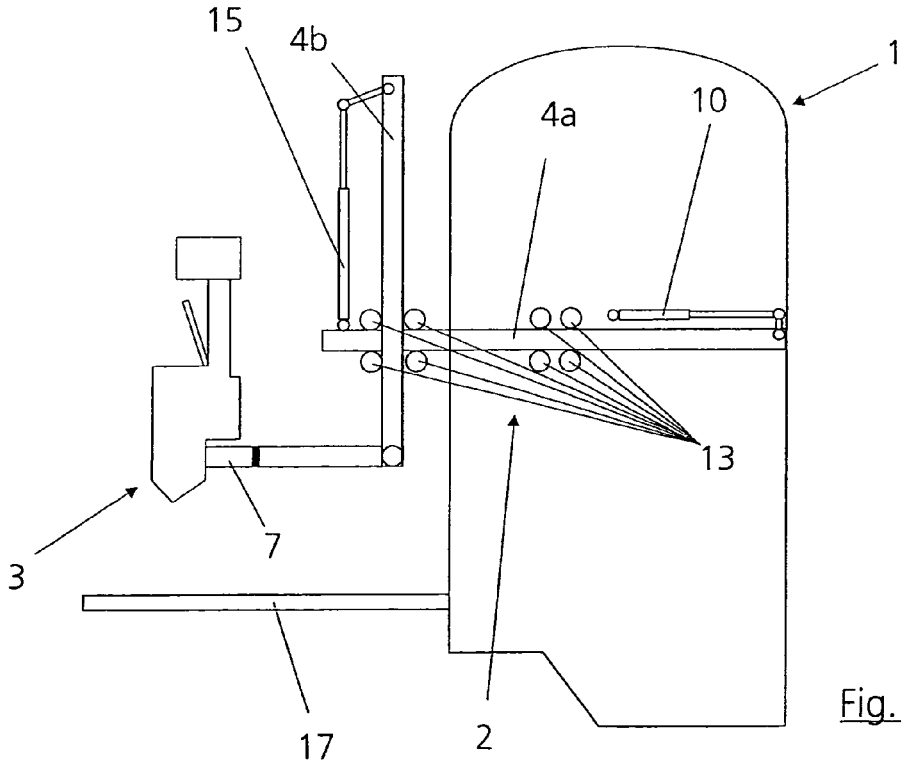
FIG. 4 shows a side view of a strapping device with a further alternative refinement of the guide device to that shown in FIG. 1.

FIG. 4 shows an alternative embodiment to that shown in FIG. 1 and FIG. 3, in which the guide device 2 has two linear guides 4*a,* 4*b.* The linear guide 4*a* can be moved in and out essentially in the horizontal direction. A further linear guide 4*b,* which can be moved essentially vertically, is arranged between the end of the linear guide 4*a* and the closure device 3. The weight force of the closure device 3 is in this case absorbed by a compressed gas cylinder 15, which is arranged parallel to the vertical linear guide 4*b*. The compressed gas cylinder 15 may in this case be arranged between the horizontal linear guide 4*a* and a projection of the vertical linear guide 4*b* or a joint element 7. One advantageous feature of the embodiment illustrated in FIG. 4 is that the compressed gas cylinder 10 always absorbs the same force irrespective of the extent to which the horizontal linear guide 4*a* is extended. However, the vertically running linear guide 4*b* can interfere with the handling of the apparatus, since the linear guide 4*b* projects vertically between the strapping device 1 and the pallet to be strapped.

The features of the exemplary embodiment shown in FIG. 1 can essentially be transferred to the exemplary embodiments shown in FIG. 3 and FIG. 4.

FIG. 4 furthermore shows an additional refinement feature for the strapping device 1, which is worthwhile for use of the guide device 2. In this case, a spacer 17 or a distance gauge is provided, by means of which it is possible to accurately determine the distance between the strapping device 1 and the pallet to be strapped. For clarity reasons, the spacer 17 is illustrated only in FIG. 4 but it may, of course, also be transferred to the other exemplary embodiments. In trials, a distance between the strapping device 1 and the pallet to be strapped of 20 to 50 cm, preferably 30 to 40 cm, has been found to be particularly suitable. The spacer 17 may, for example, be in the form of a tension spring, a plastic or rubber rod, or the like.

The spacer 17 may also be in the form of a laser or a laser pointer which produces or displays a dot or a line at a defined distance on the floor in front of the strapping device. The solution according to the invention is particularly suitable for mobile strapping devices 1, but may, of course, also be used for stationary strapping devices or for mobile strapping devices 1 which are mounted or arranged permanently or temporarily in a stationary manner.

The invention claimed is:

1. An apparatus for one of strapping and bundling of one of pallets and articles, the apparatus having a strapping device from which a packaging band can be passed around one of the pallets and articles and having a closure device for subsequent tensioning and closing the packaging band;

wherein the strapping device (1) is provided with a guide device (2) on which the closure device (3) is arranged, with the guide device (2) supporting at least some weight of the closure device (3), the guide device (2) has a guide element (5, 16) mounted for pivoting about a horizontal axis (14), with the closure device (3) supported adjacent to an end of the guide element (5, 16) to facilitate movement of the closure device (3) about the horizontal axis (14) and to facilitate linear movement of the closure device (3) toward and away from the horizontal axis (14).

2. The apparatus according to claim 1, wherein the guide device (2) has a linear guide (4) which at one end thereof supports the closure device (3).

3. The apparatus according to claim 1, wherein the closure device (3) is arranged such that the closure device (3) is movable on linear guide (4) via a joint element (7).

4. The apparatus according to claim 3, wherein a damping element (10) is arranged between the linear guide (4) and the joint element (7) for providing desired alignment of the closure device (3).

5. The apparatus according to claim 4, wherein the joint element (7) has two holes (11) which are offset by 90° with respect to one another so as to vary alignment of the closure element (3).

6. The apparatus according to claim 3, wherein the closure device (3) can pivot only within a predetermined angle range, of a maximum of about 45°, about a vertical axis (8*b*) of the joint element (7).

7. The apparatus according to claim 3, wherein the closure device (3) is connected to the joint element (7) by a detachable connection.

8. An apparatus for one of strapping and bundling of one of pallets and articles, the apparatus having a strapping device from which a packaging band can be passed around one of the pallets and articles and having a closure device for subsequent tensioning and closing the packaging band;

wherein the strapping device (1) is provided with a guide device (2) on which the closure device (3) is arranged, with the guide device (2) supporting at least some weight of the closure device (3); the guide device (2) has a guide element (5) for bearing and supporting a linear guide (4), and the guide element (5) is mounted such that the guide element (5) can pivot about a horizontal axis (14).

9. The apparatus according to claim 2, wherein the guide device (2) is connected to the strapping device (1) by a bracket.

10. The apparatus according to claim 9, wherein a damping element (15) is arranged between the bracket (6) and the guide element (5, 16) to support at least some weight of at least one of the closure element (3) and the guide device (2), and for alignment of the linear guide (4).

11. The apparatus according to claim 7, wherein the linear guide (4) is a rail, and the guide element (5) has rollers (13) for guiding and bearing against the linear guide (4).

12. The apparatus according to claim 11, wherein the guide element (5) is arranged in an inclined orientation so as to prevent the linear guide (4) from inadvertently moving in a direction of one of the pallets and articles.

13. The apparatus according to claim 1, wherein the closure device (3) is an electrical hand-held appliance.

14. The apparatus according to claim 4, wherein a damping element (15) is arranged between a bracket (6) and the guide element (5, 16) for supporting at least some weight of one of the closure element (3) and the guide device (2) and each damping element comprises a compressed gas cylinder (10, 15).

15. The apparatus according to claim 1, wherein the strapping device (1) is provided with at least one of a spacer (17) and a distance gauge.

16. The apparatus according to claim 1, wherein the guide device (2) is a joint device (16) provided with damping elements (10, 15).

17. The apparatus according to claim 1, wherein the guide element is a joint device (16).

* * * * *